US005354048A

United States Patent [19]

Winesberry, Jr.

[11] Patent Number: 5,354,048

[45] Date of Patent: Oct. 11, 1994

[54] BASKETBALL SHOOTING TEACHING DEVICE

[76] Inventor: Cornelius Winesberry, Jr., 2714 Tyee Ct., Steilacoom, Wash. 98388-1508

[21] Appl. No.: 92,891

[22] Filed: Jul. 19, 1993

[51] Int. Cl.[5] ..... A63B 69/00

[52] U.S. Cl. ..... 273/1.5 A

[58] Field of Search ..... 273/1.5 A, 1.5 R

[56] References Cited

U.S. PATENT DOCUMENTS

| | | | |
|---|---|---|---|
| 4,206,915 | 6/1980 | Woodcock | 273/1.5 A |
| 4,836,539 | 6/1989 | Knapp | 273/1.5 A |
| 5,165,680 | 11/1992 | Cass | 273/1.5 A |
| 5,184,814 | 2/1993 | Manning | 273/1.5 A |

OTHER PUBLICATIONS

KBA Basketball Coaching and Training Aids 1989 School Mail Order Catalog, Dec. 1988, p. 8.

*Primary Examiner*—Paul E. Shapiro

*Attorney, Agent, or Firm*—John P. Halvonik

[57] ABSTRACT

Basketball shooting teaching apparatus that has up to four upright members in connection with a support ring that is positioned closely against the rim of the basketball hoop by resilient attaching members. The support ring and attached uprights may be rotated around the hoop to provide a target area between the uprights for the shooter to aim at. The apparatus may also include a shooting lane delineated by streamers hung from two of the upright members to a point near where the shooter is standing. A ball return may also be used in connection with the device which comprises a pair of rigid members projecting downward from the basket for return of the ball in a direction toward a designated part of the basketball court.

6 Claims, 6 Drawing Sheets

BASKETBALL SHOOTING TEACHING DEVICE

BACKGROUND AND PRIOR ART

The invention is designed to provide a three dimensional visual cue near the basketball hoop in order to provide a better target for the shooter to aim at. By designating the target area by means of at least two upright members the shooter is given a lane (the area between the uprights) at which to aim along and the shooter is also provided with a visual target that extends in depth-i.e. the uprights are located at the front and at the back of the hoop. Such a three dimensional target is thought to enhances the shooter's sight of the hoop since it encourages him to concentrate on an imaginary lane that parallels the hoop and extends above it rather than simply aiming at the hoop which does not provide an ideal visualization of this lane.

This imaginary lane may also be enhanced by the applicant's use of lane markers, such as streamers, connected to the uprights and extending to a point near where the shooter is standing. Again, these markers help the shooter to better visualize the lane or path that ball should take.

It is believed that such a target will increase the shooter's chances for shooting baskets by providing a better target at which to shoot at which will then be reinforced positively when the shooter makes the basket. It is believed that the applicant's system of four upwardly projecting rods in connection with the basketball rim is novel.

SUMMARY OF THE INVENTION

A three dimensional basketball shooting target comprising a support rod closely connected to the basketball rim and four upright rods connected to the support. The support rod is detachably connected to the hoop (basketball rim) by resilient clamps, preferably made of urethane that clamp around the hoop. Lane markers may be used in connection with the upright rods and extend from such rods to a point near where the shooter is standing. The support rod may be rotated about the hoop in order to provide a target for the different positions that the shooter may be standing at, e.g. at a 45° angle to the backboard, or from the base line, etc.

It is an object of the invention to provide a three dimensional visual cue to a basketball shooter in order to provide a better target for shooting basketballs and to thereby aid in learning to shoot baskets.

Another objective is to provide a visual lane that extends from the hoop to a point on the basketball floor where the shooter is standing to aid him in visualizing the line of the flight of the ball.

Another objective is to provide a basketball hoop target that provides visual clues as to the depth of the hoop and the area above the hoop that the shooter needs to aim at.

Another object of the invention is to provide a basketball return that will return basketballs to a place on the floor where the shooter is standing to thereby lessen the effort of retrieving the ball and to allow the shooter to quickly reshoot the basketball to enhance the learning the shooting process.

DESCRIPTION OF THE PREFERRED EMBODIMENT

Figure 1:
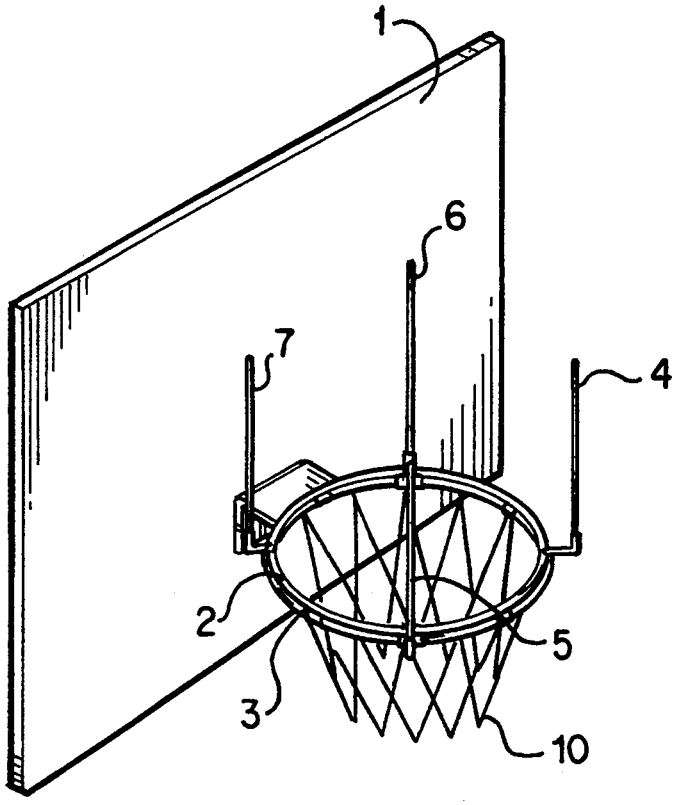
FIG. 1 Overall construction of apparatus with four upright rods.
Figure 2:
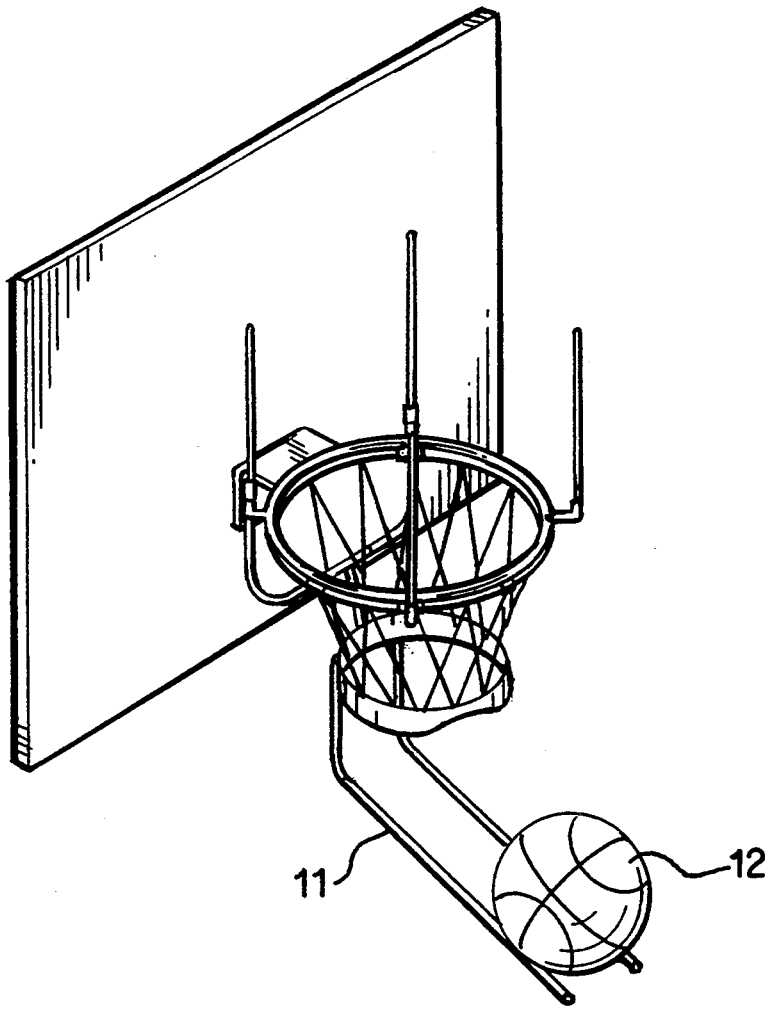
FIG. 2 Apparatus with ball return added.

The overall construction of the apparatus is as shown in FIG. 1. A support rod 2 may be constructed as a single piece and is used in close connection with the basketball goal a.k.a. the hoop or rim. The rod is circular or perhaps of oval construction. For purposes of convenience we may include circular shapes as included in the term "oval." Thus, the support rod should be no smaller than the diameter of the basketball. The support should not be too much larger than the rim, otherwise the vertical rods 4–7 (a.k.a. upright rods) extending from it would be too far apart to provide a proper visual marker.

Figure 8:
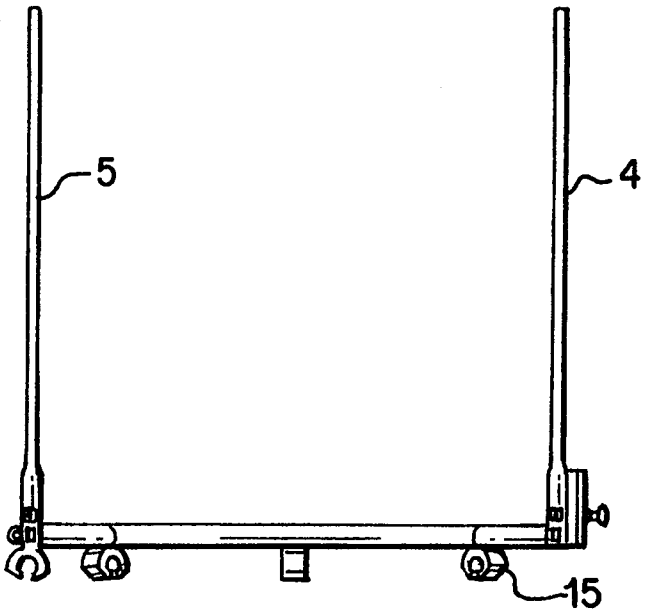
FIGS. 7 and 8 Detail showing clamps.
Figure 7:
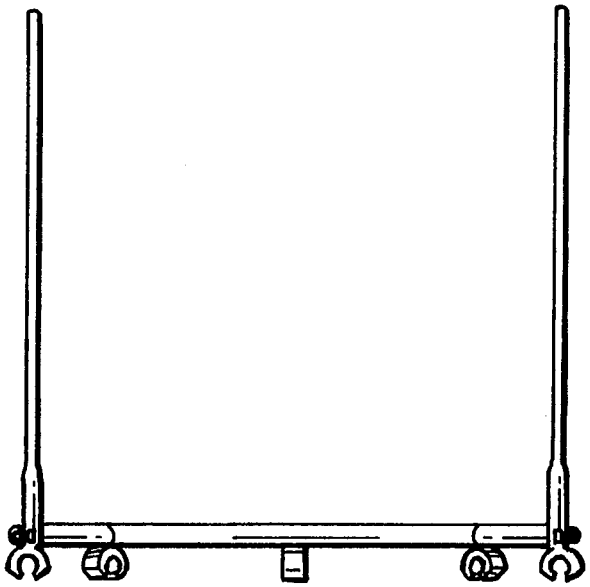

The rod is joined to the basketball hoop preferably by means of resilient clamps 15 (see FIG. 8) made of resilient material e.g. urethane. The clamps should be able to be temporarily deformed in order to slip over the rim 3 and then return to their previous shape so as to clamp around the hoop. By using such clamps, the support ring may be attached to rims as needed and also allows the vertical rods to be rotated a certain interval. This rotation may be important so that one can line up the upright rods in a direction to accommodate shooters who are in different positions on the court.

At least two vertical rods should be used. If two rods are used, they would be at the front of the rim when the shooter is standing at the free throw line, i.e. away from the backboard as opposed to the back of the rim which is near the backboard. The front two vertical rods 4 and 5 define a shooting area between those rods for the shooter, they will necessarily block shots that are not coming in that direction.

Figure 3:
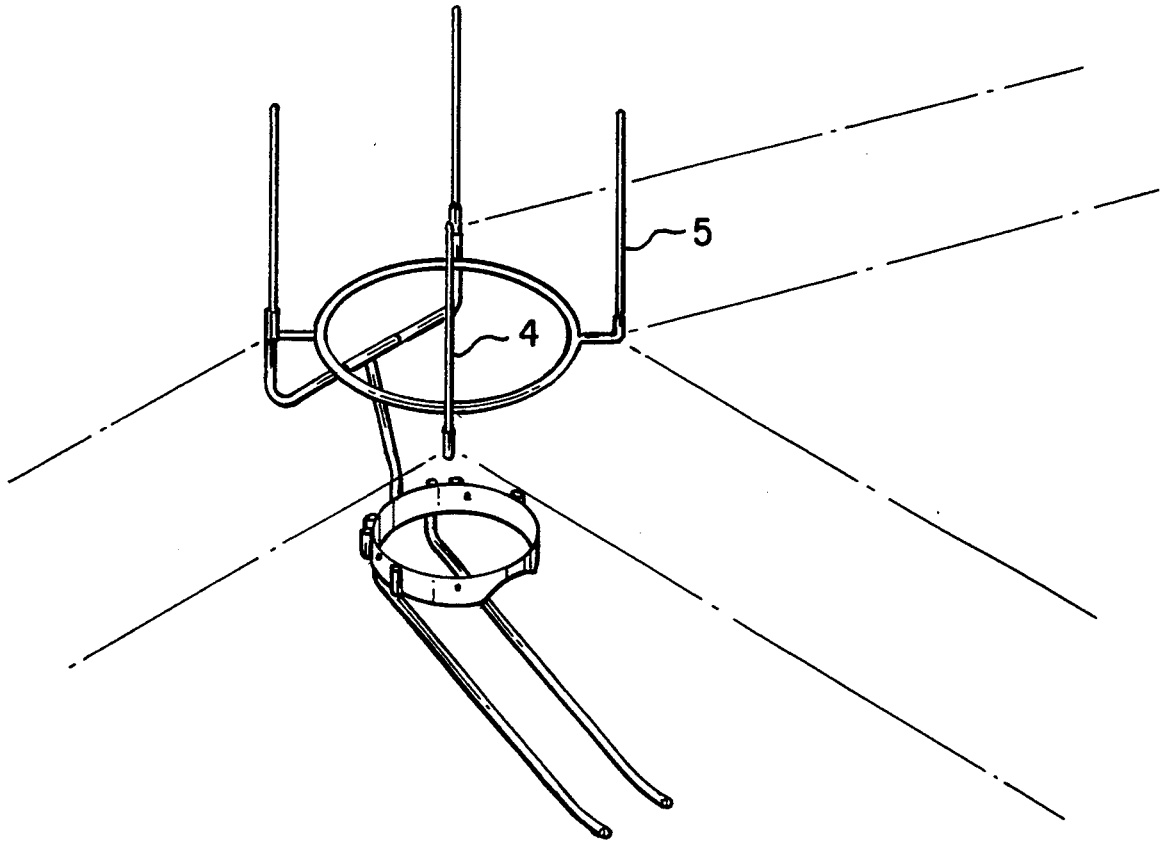
FIG. 3 Imaginary shooting lanes formed by upright rods.
Figure 4:
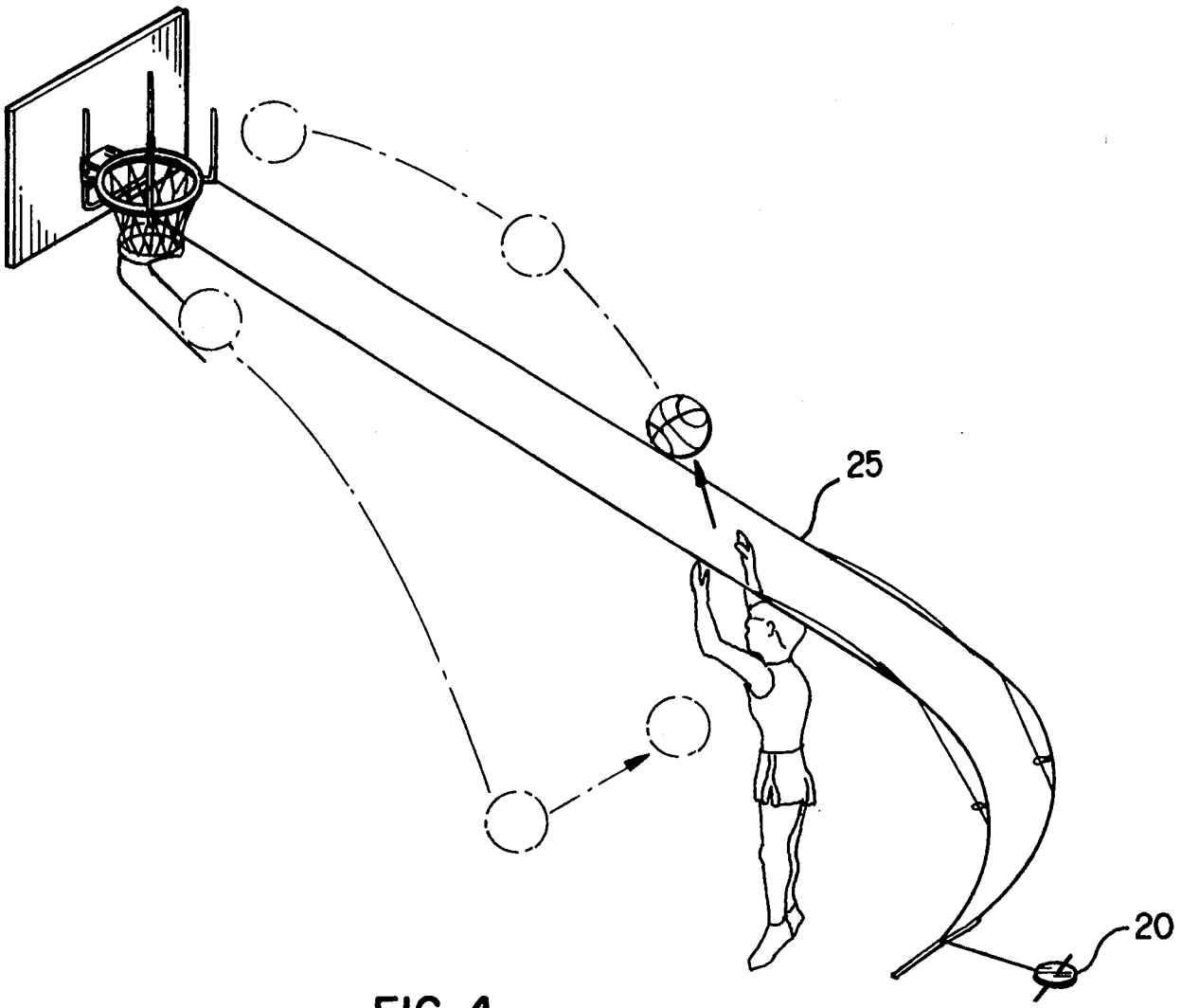
FIG. 4 Apparatus in use with lane markers added.

For purposes of convenience we may call this area between the front two rods and extending to the shooter the "lane" see FIGS. 3 and 4. For instance, if the front upright rods are in a line parallel to the backboard, the shooter would stand directly in front of the hoop, e.g. at the free throw line or the top of the key.

If the shooter stands at an angle to this lane, the front rods would block shots from this direction. It thus becomes necessary for the rods to be rotated e.g. 45° for the shooter who is standing at that angle to the basket, i.e. between the free throw line and the base line. Of course, if the shooter is standing at the base line, the two front rods would be rotated 90° to accommodate this angle. In all the examples, the rods would form the end points of a shooting lane that extends from the shooter to the basket.

Figure 6:
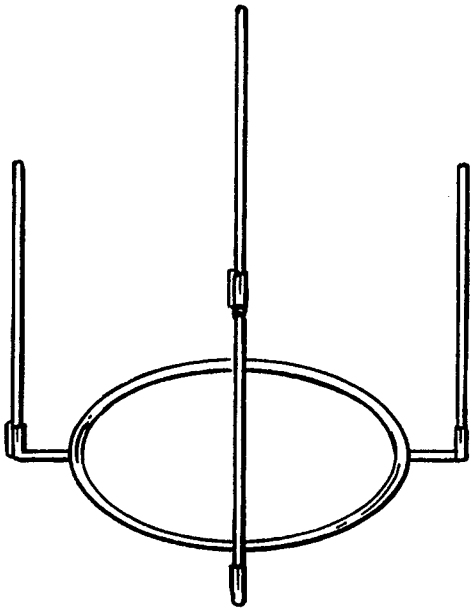
FIG. 6 Side view of support rods and uprights.
Figure 5:
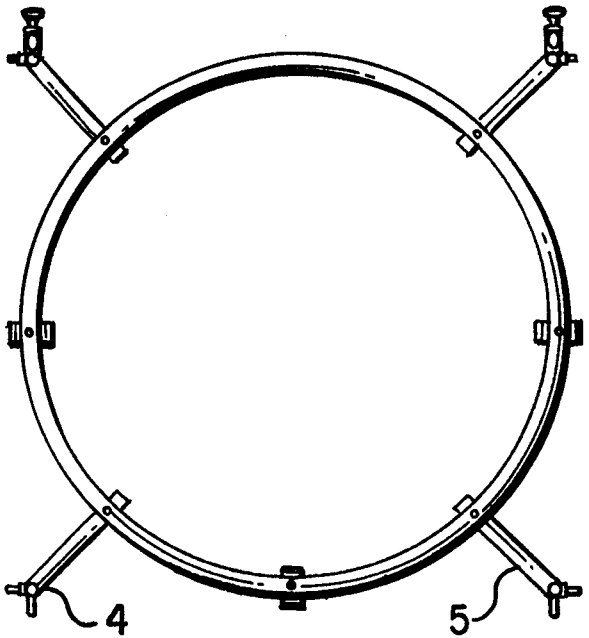
FIG. 5 Top view of support rod and uprights.

Again in the example above, if four rods are used, they would be in a square configuration around the rim with two rods at the front (forming that area for the shooter to aim) and preferably two rods near the back (i.e. close to the backboard). A shooter at the free throw line or a shooter at the base line could shoot at this square configuration, see e.g. FIGS. 3 and 6. The shooter at the foul line would aim at the area between the front rods and the shooter at the base line would aim between one of the front rods and one of the back rods.

Of course the support ring could still be rotated fully 360° although that much rotation would probably not be necessary. The support ring could rotate in any increment between 0° and 360°.

It is also possible that three rods may be used in connection with the support ring. It is thought important to the invention that there should be at least two rods near the front of the hoop in order to define the lane for the shooter. If three rods are used, there would preferably be two at the front of the rim and one near the back of the rim. It is possible that there could be one upright rod at the front and two at approximately 90° from this front upright so that the three upright rods would form a triangle configuration.

Lane markers 25, made of rope, fiberglass or other bendable materials may be connected to the front rods in order to further define the imaginary lane, see FIG. 4. The lane markers should extend from the front rods to a point near where the shooter stands. A support 20 for the markers may be used in order to secure the markers to the basketball floor or other horizontal surface.

The ball return 11 should made of metal or other durable composite materials and has two pieces that project downward from the hoop. They are spaced apart a distance to support a basketball 12 and direct it downward and away from the hoop, preferably in a direction that leads toward the shooter so that the shooter may attempt the next shot without having to reach very far for the ball.

It is preferred that the upright rods in connection with the rim be about 18" apart or less and about 18" in height. Greater or lesser heights may also be used without violating the spirit of the invention.

I claim:

1. A target apparatus for connection to a hoop for providing a target for shooting a ball, said apparatus comprising: a support rod of oval construction and having a diameter at least that of said ball, said support rod having at least one means for connection to said hoop, at least two upright target rods in connection with said support rod and extending above said hoop, said upright target rods spaced apart from one another a distance of at least the diameter of said ball, said upright rods about 18" apart and said upright rods at least about 18" in height.

2. The apparatus of claim 1 having a third upright rod in connection with said support rod, said third upright rod being spaced apart from said upright rods at least the diameter of said ball.

3. The apparatus of claim 2 having a fourth upright rod in connection with said support rod, said fourth upright rod being spaced apart from said upright rods at least the diameter of said ball.

4. The apparatus of claim 3 having a pair of lane markers having a front end in connection with said front rods and having a back end having a support means, said support means for supporting said markers upon a horizontal planar surface.

5. The apparatus of claim 2 having a pair of lane markers having a front end in connection with said front rods and having a back end having a support means, said support means for supporting said markers upon a horizontal planar surface.

6. The apparatus of claim 1 having a pair of lane markers having a front end in connection with said front rods and having a back end having a support means, said support means for supporting said markers upon a horizontal planar surface.

* * * * *